US006554762B2

(12) United States Patent
Leysieffer

(10) Patent No.: US 6,554,762 B2
(45) Date of Patent: Apr. 29, 2003

(54) IMPLANTABLE HEARING SYSTEM WITH MEANS FOR MEASURING ITS COUPLING QUALITY

(75) Inventor: Hans Leysieffer, Taufkirchen (DE)

(73) Assignee: Cochlear Limited, Lane Cove (AU)

( * ) Notice: Subject to any disclaimer, the term of this patent is extended or adjusted under 35 U.S.C. 154(b) by 0 days.

(21) Appl. No.: 09/938,535

(22) Filed: Aug. 27, 2001

(65) Prior Publication Data

US 2002/0026091 A1 Feb. 28, 2002

(30) Foreign Application Priority Data

Aug. 25, 2000 (DE) ..... 100 41 726

(51) Int. Cl.[7] ..... H04R 25/00
(52) U.S. Cl. ..... 600/25
(58) Field of Search ..... 600/25, 22, 559; 381/68–69, 71, 312, 328; 607/55–57; 623/10, 11; 181/126, 130, 135

(56) References Cited

U.S. PATENT DOCUMENTS

| | | | | |
|---|---|---|---|---|
| 3,712,962 | A | | 1/1973 | Epley |
| 3,870,832 | A | | 3/1975 | Fredrickson |
| 3,882,285 | A | | 5/1975 | Nunley et al. |
| 4,850,962 | A | | 7/1989 | Schaefer |
| 5,015,224 | A | | 5/1991 | Maniglia |
| 5,015,225 | A | | 5/1991 | Hough et al. |
| 5,277,694 | A | | 1/1994 | Leysieffer et al. |
| 5,279,292 | A | | 1/1994 | Baumann et al. |
| 5,554,096 | A | | 9/1996 | Ball |
| 5,624,376 | A | | 4/1997 | Ball et al. |
| 5,707,338 | A | | 1/1998 | Adams et al. |
| 5,788,711 | A | | 8/1998 | Lehner et al. |
| 5,814,095 | A | | 9/1998 | Muller et al. |
| 5,941,814 | A | | 8/1999 | Lehner et al. |
| 5,999,632 | A | | 12/1999 | Leysieffer et al. |
| 6,068,589 | A | * | 5/2000 | Neukermans ..... 600/25 |
| 6,077,215 | A | | 6/2000 | Leysieffer |
| 6,123,660 | A | | 9/2000 | Leysieffer |
| 6,131,581 | A | | 10/2000 | Leysieffer et al. |
| 6,162,169 | A | | 12/2000 | Leysieffer |
| 6,198,971 | B1 | | 3/2001 | Leysieffer |

FOREIGN PATENT DOCUMENTS

| | | |
|---|---|---|
| WO | WO 98/06235 | 2/1998 |
| WO | WO 98/06236 | 2/1998 |
| WO | WO 98/06237 | 2/1998 |
| WO | WO 98/06238 | 2/1998 |
| WO | WO 98/36711 | 8/1998 |

OTHER PUBLICATIONS

Zenner, H. P. et al. pp. 749–774, Oct. 1997, HNO vol. 45.
Fredrickson et al., "Ongoing Investigations Into an Implatable Electromagnetic Hearing Aid for Moderate to Severe Sensorineural Hearing Loss", pp. 107–121, 1995, Otolaryngologic Clinics of North America, vol. 28/1.

(List continued on next page.)

*Primary Examiner*—Eric F. Winakur
*Assistant Examiner*—Nikita R Veniaminov
(74) *Attorney, Agent, or Firm*—Nixon Peabody LLP; David B. Safran

(57) ABSTRACT

An at least partially implantable system for rehabilitation of a hearing disorder comprising at least one acoustic sensor for picking up acoustic sensor signals and converting the acoustic sensor signals into corresponding electrical audio sensor signals; an electronic signal processing unit for audio signal processing and amplification of the electrical sensor signals; an electrical power supply unit which supplies individual components of the system with energy; at least one electromechanical output transducer which has an electrical input impedance and which, when implanted, is coupled via a coupling element to at least one of a middle ear and an inner ear for mechanical stimulation thereof; and means for objectively determining the quality of coupling between the at least one output transducer and the least one of the middle ear and the inner ear, said determining means comprising impedance measuring means for measuring the mechanical impedance of a biological load structure which, upon implantation of the output transducer, is coupled to the output transducer.

31 Claims, 9 Drawing Sheets

OTHER PUBLICATIONS

Leysieffer et al. pp. 792–800, Oct. 1997, HNO vol. 45.

Yanigahara et al., "Efficacy of the Partially Implantable Middle Ear Implant in Middle and Inner Ear Disorders", pp. 149–159, 1988, Adv. Audiol. vol. 4, Karger Basel.

Suzuki et al., "Implantation of Partially Implantable Middle Ear Implant and the Indication", pp. 160–166, 1988, Adv. Audiol., vol. 4, Karger Basel.

Maniglia et al., "Contactless Semi–Implantable Electromagnetic Middle Ear Device for the Treatment of Sensorineural Hearing Loss", pp. 121–141, 1995, Otolaryngologic Clinics of North America, vol. 28/1.

Leysieffer et al. pp. 853–863 and 844–852, 1998, HNO vol. 46.

* cited by examiner

IMPLANTABLE HEARING SYSTEM WITH MEANS FOR MEASURING ITS COUPLING QUALITY

BACKGROUND OF THE INVENTION

1. Field of the Invention

This invention relates to an at least partially implantable hearing system for rehabilitation of a hearing disorder comprising at least one acoustic sensor for picking up an acoustic signal and converting the acoustic signal into corresponding electrical audio sensor signals, an electronic signal processing unit for audio signal processing and amplification, an electrical power supply unit which supplies individual components of the system with energy, and at least one electromechanical output transducer which has an electrical input impedance and which, when implanted, is coupled via a coupling element to at least one of a middle ear and an inner ear for mechanical stimulation thereof 2. Description of Related Art The expression "hearing disorder" is defined here as including an inner ear damage, a combined inner ear and middle ear damage, and a temporary or permanent noise impression (tinnitus).

Electronic measures for rehabilitation of inner ear damage which cannot be cured by surgery have currently achieved great importance. With total failure of the inner ear, cochlear implants with direct electrical stimulation of the remaining auditory nerves are in routine clinical use. For medium to severe inner ear damage, for the first time, fully digital hearing devices are presently being used which open up a new world of electronic audio signal processing and offer expanded possibilities of controlled audiological fine tuning of the hearing devices to the individual inner ear damage. In spite of major improvements of hearing aid hardware achieved in recent years, in conventional hearing aids, there remain basic defects which are caused by the principle of acoustic amplification, i.e. especially by the reconversion of the electronically amplified signals in airborne sound. These defects include aspects such as the visibility of the hearing aids, poor sound quality as a result of electromagnetic transducers (speakers), closed external auditory canal as well as feedback effects at high acoustic gain.

As a result of these fundamental defects, there has long been the desire to move away from conventional hearing aids with acoustic stimulation of the damaged inner ear and to replace them by partially or fully implantable hearing systems with direct mechanical stimulation. Implantable hearing systems differ from conventional hearing aids: the acoustic signal is converted with a proper microphone into an electrical signal and amplified in an electronic signal processing stage; this amplified electrical signal, however, is not sent to an electroacoustical transducer (speaker), but to an implanted electromechanical transducer providing for output-side mechanical vibrations which are sent directly, therefore with direct mechanical contact, to the middle ear or inner ear, or indirectly via an air gap in, for example, electromagnetic converter systems. This principle applies regardless of whether implantation of all necessary system elements is partial or complete and also regardless of whether an individual with pure inner ear impairment with a completely intact middle ear or an individual with combined hearing impairment, in which the middle and inner ear is damaged, is to be rehabilitated. Therefore implantable electromechanical transducers and methods for coupling the mechanical transducer vibrations to the functioning middle ear or directly to the inner ear for rehabilitation of a pure inner ear impairment, or to a remaining ossicle of the middle ear in the case of an artificially or pathologically altered middle ear for taking care of a hearing disorder caused by a disturbance of sound conduction, or for combinations of such disorders, have been described in the recent scientific literature and in many patents.

Useful electromechanical transducer processes include basically all physical transducer principles, such as electromagnetic, electrodynamic, magnetostrictive, dielectric and piezoelectric. Various research groups, in recent years, have focused essentially on two of these processes, namely electromagnetic and piezoelectric processes. A survey can be found in H. P. ZENNER and H. LEYSIEFFER (HNO 10/1997, vol. 45, pp. 749–774).

In the piezoelectric process, direct mechanical coupling of the output-side transducer vibrations to the middle ear ossicle or to the oval window is essential. In the electromagnetic principle, force coupling between the transducer and ossicle, on the one hand, can take place "without contact", i.e. via an air gap; in this case, only the permanent magnet is caused to vibrate by the transducer being in direct mechanical contact with the middle ear ossicle by permanent fixation. On the other hand, it is possible to implement the transducer entirely in a housing (in this case the coil and the magnet preferably being coupled with the smallest possible air gap) and to transmit the output-side vibrations via a mechanically stiff coupling element with direct contact to the middle ear ossicle (see FREDRICKSON et al.: *Ongoing investigations into an implantable electromagnetic hearing aid for moderate to severe sensorineural hearing loss*; Otolaryngologic Clinics of North America, Vol. 28/1 (1995), pp. 107–121; and H. Leysieffer et al., HNO 10/97, vol. 45, pp. 792–800).

The patent literature contains some of the aforementioned versions of both electromagnetic and also piezoelectric hearing aid transducers: U.S. Pat. No. 3,712,962, EPLEY; U.S. Pat. No. 3,870,832, FREDRICKSON; U.S. Pat. No. 3,882,285, NUNLEY et al.; U.S. Pat. No. 4,850,962, SCHAEFER; U.S. Pat. No. 5,015,224, MANIGLIA; U.S. Pat. No. 5,277,694, LEYSIEFFER et al.; U.S. Pat. No. 5,554,096, BALL; U.S. Pat. No. 5,707,338, ADAMS et al.; U.S. Pat. No. 6,123,660, LEYSIEFFER; U.S. Pat. No. 6,162,169, LEYSIEFFER; International Patent Application Publications WO-A 98/06235, ADAMS et al.; WO-A 98/06238, ADAMS et al.; WO-A 98/06236, KROLL et al.; WO-A 98/06237, BUSHEK et al.

The partially implantable piezoelectric hearing system of the Japanese group of Suzuki and Yanigahara presupposes, for implantation of the transducer, the absence of the middle ear ossicles and a free tympanic cavity to be able to couple the piezo element to the stapes (Yanigahara et al.: *Efficacy of the partially implantable middle ear implant in middle and inner ear disorders*: Adv. Audiol., Vol. 4, Karger Basel (1988), pp. 149–159; Suzuki et al.: *Implantation of partially implantable middle ear implant and the indication*. Adv. Audiol., Vol. 4, Karger Basel (1988), pp. 160–166). Likewise, in the method of implanting a hearing system for inner ear hearing-impaired according to SCHAEFER (U.S. Pat. No. 4,850,962) basically the incus is removed in order to be able to couple a piezoelectric transducer element to the stapes. This also applies to further developments which are based on the SCHAEFER technology and which are described in the above mentioned patents (U.S. Pat. No. 5,707,338, ADAMS et al.; International Patent Application Publications WO-A 98/06235, ADAMS et al.; WO-A 98/06238, ADAMS et al.; WO-A 98/06236, KROLL et al.; WO-A 98/06237, BUSHEK et al.).

The BALL electromagnetic transducer ("Floating Mass Transducer FMT" of U.S. Pat. No. 5,554,096, BALL; U.S. Pat. No. 5,624,376, BALL et al.) is, on the other hand, directly fixed to the long process of the incus when the middle ear is intact. The electromagnetic transducer of the partially implantable system of FREDRICKSON (Fredrickson et al.: *Ongoing investigations into an implantable electromagnetic hearing aid for moderate to severe sensorineural hearing loss*, Otolaryngologic Clinics of North America, Vol. 28/1 (1995), pp. 107–121) is directly mechanically coupled to the body of the body of the incus when the ossicular chain of the middle ear is likewise intact. The same applies to the piezoelectric transducers of LEYSIEFFER (LEYSIEFFER et al.: *An implantable piezoelectric hearing aid converter for the inner ear hearing-impaired*. HNO 1997/45, pp. 792–800; U.S. Pat. No. 5,277,694, LEYSIEFFER et al.; U.S. Pat. No. 6,123,660, LEYSIEFFER; U.S. Pat. No. 6,162,169, LEYSIEFFER). Also in the electromagnetic transducer system of MANIGLIA (MANIGLIA et al.: *Contactless semi-implantable electromagnetic middle ear device for the treatment of sensorineural hearing loss*, Otolaryngologic Clinics of North America, Vol. 28/1 (1995), pp. 121–141) with the ossicular chain intact a permanent magnet is permanently mechanically fixed to the ossicular chain, but is mechanically driven via an air gap coupling by a coil.

In the described transducer and coupling versions, basically, two implantation principles can be distinguished:

a) In the case of the one principle the electromechanical transducer with its active transducer element is located itself in the middle ear region in the tympanic cavity and the transducer is directly connected there to an ossicle or to the inner ear (U.S. Pat. Nos. 4,850,962, 5,015,225, 5,707,338, 5,624,376, 5,554,096, and International Patent Application publication Nos. WO 98/06235, WO 98/06238, WO 98/06236, and WO 98/06237).

b) In the other principle the electromagnetic transducer with its active transducer element is located outside of the middle ear region in an artificially formed mastoid cavity; the output-side mechanical vibrations are then transmitted to the middle or inner ear by means of mechanically passive coupling elements via suitable surgical accesses (the natural aditus ad antrum, opening of the chorda-facialis angle or via an artificial hole from the mastoid) (Fredrickson et al.: *Ongoing investigations into an implantable electromagnetic hearing aid for moderate to severe sensorineural hearing loss*. Otolaryngologic Clinics of North America, Vol. 28/1 (1995), pp. 107–121; U.S. Pat. No. 5,277,694; U.S. Pat. No. 6,123,660; U.S. Pat. No. 6,162,169).

An advantage of the a) type versions is, that the transducer can be made as a so-called "floating mass" transducer, i.e., the transducer element does not require any "reaction" via secure screwing to the skull bone, but it vibrates based on the laws of mass inertia with its transducer housing and transmits these vibrations directly to a middle ear ossicle (U.S. Pat. Nos. 5,624,376, 5,554,096, and 5,707,338, and International Patent Application publication no. WO 98/06236). On the one hand, this means that an implantable fixation system on the cranial vault can be advantageously omitted; on the other hand, this version disadvantageously means that bulky artificial elements must be placed in the tympanic cavity, and their long-term stability and biostability are currently not known or guaranteed, especially in the case of temporary pathological changes of the middle ear (for example, otitis media). Another major disadvantage is that the transducer together with its electrical supply line has to be transferred from the mastoid into the middle ear and must be fixed there using suitable surgical tools; this requires an expanded access through the chorda facialis angle, and thus, entails a latent hazard to the facial nerve which is located in the immediate vicinity. Furthermore, such "floating mass" transducers can be used merely in a very limited manner or not at all, when the inner ear is to be directly stimulated for example via the oval window, or when, due to pathological changes, for example the incus is substantially damaged or is no longer present, so that such a transducer no longer can be mechanically connected to an ossicle that is able to vibrate and is in connection with the inner ear.

A certain disadvantage of the transducer versions as per b) is that the transducer housing is to be attached to the cranial vault with the aid of implantable positioning and fixation systems (advantageous embodiment U.S. Pat. No. 5,788,711). A further disadvantage of the transducer versions as per b) is that a recess is to be made, preferably by an appropriate laser, in the respective ossicle in order to allow the application of the coupling element. This, on the one hand, is technically complicated and expensive and, on the other hand, involves risks for the patient. Both in the partially implantable system of FREDRICKSON ("*Ongoing investigations into an implantable electromagnetic hearing aid for moderate to severe sensorineural hearing loss*", Otolaryngologic Clinics of North America, Vol. 28/1 (1995), pp. 107–121) as well as in the fully implantable hearing system of LEYSIEFFER and ZENNER (HNO 1998, vol. 46, 853–863 and 844–852), when the vibrating transducer part is coupled to the body of the incus, it is assumed that for permanent and mechanically secure vibration transmission the tip of the coupling rod which is placed in the laser-induced depression of the middle ear ossicle undergoes osseointegration over the long term, i.e., the coupling rod coalesces solidly with the ossicle and thus ensures reliable transmission of dynamic compressive and tensile forces. However, this long-term effect is currently not yet scientifically proven or certain. Furthermore, in this type of coupling, in case of a technical transducer defect, there is the disadvantage that decoupling from the ossicle to remove the transducer can only be done with mechanically based surgical methods; this can mean considerable hazard to the middle ear and especially the inner ear. Therefore further coupling elements, partly involving novel surgical access paths, were developed which minimize or no longer have the above mentioned disadvantages (U.S. Pat. No. 5,941,814, LEHNER et al., commonly owned U.S. patent applications Ser. Nos. 09/576,009; 09/613,560; 09/626,745; 09/680,489).

The major advantage of these converter embodiments as per b), however, is that the middle ear remains largely free and coupling access to the middle ear can take place without major possible hazard to the facial nerve. One preferable surgical process for this purpose is described in U.S. Pat. No. 6,077,215, LEYSIEFFER.

In view of the described various modes of access and coupling techniques numerous coupling elements for transmitting in an effective and long-term stable manner the mechanical vibratory energy of the transducers to the coupling site of the middle ear or inner ear were developed and described. Also implantable hearing systems were described which use, for stimulation of the damaged hearing, not only a single transducer but rather a plurality of electromechanical transducers to provide for an optimum stimulation of the multi-channel cochlear amplifier and thus to attain a better rehabilitation of the damaged hearing than when utilizing a single transducer only. Advantageous embodiments of such coupling elements and transducer arrangements are described in more detail below.

The coupling quality of the mechanical excitation is influenced by many parameters and contributes significantly to rehabilitation of hearing loss and to the perceived hearing quality. Intraoperatively, this quality of coupling can only be assessed with difficulty or not at all, since the amplitudes of motion of the vibrating parts even at the highest stimulation levels are in a range around or far below 1 $\mu$m, and therefore, they cannot be assessed by direct visual inspection. Even as this is done using other technical measurement methods, for example, by intraoperative laser measurements (for example, laser doppler vibrometry), the uncertainty of a long-term stable, reliable coupling remains, since this can be adversely affected among others by necroses formation, tissue regeneration, air pressure changes and other external and internal actions. In particular, in completely implantable systems, it remains necessary to be able to assess the coupling quality of the transducer, since in a full implant, it is not possible to separately measure individual system components at their technical interfaces if, for example, the implant wearer complains of inferior transmission quality which cannot be improved by reprogramming of individual audiological adaptation parameters, and therefore, surgical intervention to improve the situation cannot be precluded. Even if this is not the case, there is fundamental scientific interest in having available a reliable monitor function of long term development of the quality of the transducer coupling.

International Patent Application Publication WO-A 98/36711 proposes a process utilizing objective hearing testing methods, such as ERA (electric response audiometry), ABR (auditory brainstem response) or electrocochleography, in the case of fully and partially implantable systems with mechanical or electrical stimulation of the damaged or failing hearing. Stimuli responses evoked by application of proper stimuli are objectively detected by electrical extraction via external head electrodes or implanted electrodes. This method has the advantage that objective data for the transmission quality can be determined during a surgical procedure under general anesthesia. The essential disadvantages, however, amongst others, are that these objective hearing testing methods can be of qualitative nature only, essentially provide for data at the auditory threshold only and not or only to a limited extent above this threshold, and particularly are of insufficient accuracy in the case of frequency-specific measurements. A subjective valuation of the transmission quality and subjective audiological measurements in the region above the auditory threshold, such as loudness scalings, are not possible.

It has been proposed (commonly owned copending U.S. patent application Ser. No. 09/369,180) to circumvent the indicated disadvantages by determining the quality of coupling of the electromechanical transducer to the middle or inner ear, respectively, by psychoacoustical measurements, i.e. by subjective patient replies, without further biological-technical interfaces which may impair the determination of the transducer coupling quality being included in the valuation. For this purpose an audiometer is integrated into a fully implantable hearing system or into the implantable part of a partially implantable hearing system. This audiometer consists of one or more electronic signal generators which can by set or programmed from the outside and which feed an electrical hearing test signal into the signal processing path of the implant. Thereby, the electromechanical output transducer of the implanted hearing system is directly electrically controlled in a technically reproducible and quantitatively predetermined manner, so that corruption of the stimulation level, as can occur for example by presenting the audiometrical test sounds by headphones or particularly acoustic free field presentation, is avoided because the sensor or microphone function together with all associated variability is incorporated into the psychoacoustical measurement.

This procedure, amongst others, has the advantage that e.g. frequency-specific measurements of the auditory threshold using pure sinusoidal tones or narrow-band signals (for example, third octave noise) can be very easily reproduced even at longer study time intervals. Furthermore, the procedure also permits the acquisition of reproducible psychoacoustical data in the region above the auditory threshold, such as loudness scalings. In addition, by offering pure signals, such as, for example, sinusoidal signals, nonlinearities which can arise, for example, by diminishing coupling quality and which can be perceived as nonlinear distortions, may also be subjectively interrogated. Such studies are possible to only a limited extent or not at all by the above described objective measurement methods based upon evoked potentials.

All the discussed methods for examining the coupling quality of the electromechanical transducer or transducers are disadvantageous in that either a subjective valuation of the patient influences the result or that physiological interfaces are included in the measurement. Both aspects lead to unreliable measuring results and hence do not represent an optimum solution, particularly with respect to reproduced

SUMMARY OF THE INVENTION

A primary object of the present invention is to devise an at least partially implantable hearing system which permits in a particularly reliable manner an objective measurement of the coupling quality even during operation.

This object is achieved in that, in an at least partially implantable hearing system for rehabilitation of a hearing disorder comprises at least one acoustic sensor for picking up an acoustic signal and converting the acoustic signal into corresponding electrical audio sensor signals, an electronic signal processing unit for audio signal processing and amplification, an electrical power supply unit which supplies individual components of the system with energy, at least one electromechanical output transducer for mechanical stimulation of the middle and/or inner ear, and means for objectively determining the quality of coupling between the at least one output transducer and at least one of the middle ear and the inner ear, said determining means comprising impedance measuring means for measuring the mechanical impedance of a biological load structure which, upon implantation of the output transducer, is coupled to the output transducer.

The solution of the subject invention has the particular advantage that the coupling quality of the output transducer or output transducers can be intraoperatively judged and, if necessary, intraoperatively improved immediately upon coupling of the transducer to the biological hearing structure before the implantation is terminated without having exact knowledge about the success of the coupling since normally the patient is operated under general anesthesia so that psychoacoustical measurements are not possible.

A further advantage of the subject invention is that the coupling quality of the output transducer or output transducers can be postoperatively monitored on a long-time base without the necessity of subjecting the patient to any particular procedure. For this purpose the software surface used by the audiologist or the hearing aid acoustician to adapt the implant to the individual impaired hearing, for example, includes a module for triggering an implant-side impedance measurement either automatically on occasion of software initialization or by an active request, with the respective data being telemetrically transmitted to the software surface for further evaluation and judgement.

Furthermore, in conformity with the invention, such impedance measurements may be triggered and carried out by the implant itself, without an active measuring command, at predetermined time intervals or upon the occurrence of a predetermined operational state of the implant, with respective impedance measurement results being stored as digital data in a respective storage area of the implant at least until retrieval of the impedance measurement results from the outside.

The impedance measuring means may comprise means for measuring the electrical input impedance of the electromechanical output transducer or transducers coupled to the biological load structure. The magnitude and phase data of this electrical input impedance reflect the load components coupled to the transducer or transducers because these are transformed to the electrical side by the electromechanical coupling of the transducer or transducers, and thus can be measured.

Preferably, the or each electromechanical output transducer is driven by a driver unit to which the respective output transducer is connected via a measuring resistance, and a measuring amplifier is provided which has applied thereto as input signals the transducer terminal voltage and a measuring voltage which is dropped across the measuring resistance and is proportional to the transducer current. In order to preclude a corruption of the measurements, the voltage drop across the measuring resistance preferably is taken off in a floating and high impedance manner, and the measuring resistance advantageously is dimensioned such that the sum of the resistance value of the measuring resistance and of the absolute value of the complex electrical input impedance of the electromechanical output transducer coupled to the biological load structure is large with respect to the internal resistance of the driver unit. Furthermore, preferably digital, means are provided for forming the quotient of the transducer terminal voltage and the transducer current.

According to an alternate embodiment of the invention the impedance measuring means, however, also may be designed for direct measurement of the mechanical impedance of the biological load structure coupled, upon implantation of the output transducer, to the electromechanical output transducer, and such impedance measuring means may be integrated into the output transducer at an actoric output side thereof. Preferably, the impedance measuring means is designed for generating measuring signals which are at least approximately proportional as to magnitude and phase to either the force acting on the biological load structure or the velocity of the coupling element. In such a case, the system advantageously further includes a two-channel measuring amplifier with multiplexer function and, preferably digital, means for providing the quotient of the measuring signal corresponding to the force acting on the biological load structure and of the measuring signal corresponding to the velocity of the coupling element.

In the case of the direct impedance measurement the electromechanical output transducer and the impedance measuring means may be disposed within a common housing which optionally also receives the measuring amplifier.

The described impedance measurements by no means are restricted to a single measuring frequency or to a single measuring level. Rather, advantageously for indirect as well as for direct measurement of the mechanical impedance of the biological load structure, preferably digital, means are provided for measuring the mechanical impedance of the biological load structure coupled, upon implantation of the output transducer, to the electromechanical output transducer as a function of the frequency and/or of the level of the stimulation signal delivered by the output transducer. Measurements extending over the entire transmission frequency range and the entire stimulation level range of the respective hearing implant are particularly suited to gain, during the postoperative monitoring phase, important detailed information about linear and particularly non-linear variations of the quality of the coupling of the electromechanical output transducer or transducers to the biological load structure. Thus, for example, it may be expected that a mechanical non-linearity of the coupling to a middle ear ossicle ("distortion") that may negatively influence the transmitted sound quality, can be detected by varying the electrical level during the impedance measurement.

In conformity with a further embodiment of the invention, preferably digital, means may be provided for detecting the spectral distribution of resonance frequencies in the course of the mechanical impedance measured as a function of the frequency of the stimulation signal, and also means for detecting the difference between values of the mechanical impedance occurring at the resonance frequencies. This difference gives information as to the mechanical oscillation Q.

The above described approach basically may be utilized in connection with all known transducer principles, such as in the case of electromagnetic, electrodynamic, magnetostrictive, dielectric and particularly piezoelectric transducers. Accordingly, in the system design of the hearing implant there are basically no restrictions as to the type of transducers, and in a multi-channel actor design also mixed types of transducer principals may be provided for in order to attain an optimum stimulation of the hearing.

The electromechanical output transducer, in the implanted state, may be mechanically connected to the biological load structure via a passive coupling element and/or a coupling rod, and the impedance measuring means may be incorporated into the coupling rod.

Preferably, the electronic signal processing unit is designed to also process the signals of the impedance measuring means. Advantageously, the signal processing unit comprises a digital signal processor which provides for processing of the signals of the impedance measuring means as well as for processing the audio sensor signals and/or for generation of digital signals for tinnitus masking. In order to provide for the respective actual measurement of the electrical transducer impedance, the signal processor may shortly interrupt the audio signal of the hearing system to supply the respective measuring signals which, for example, are generated by the signal processor itself In case no level analysis as to non-linearities of the transducer coupling over the entire range of useful levels is provided for, the measurement of the electrical transducer impedance also may be carried out below the auditory threshold in quiet of the respective patient in order to avoid disturbance of the patient by the measuring signals. For this purpose, the respective patient's data relating to the auditory threshold in quiet may be stored in a storage area of the system, and the measuring software of the signal processor then may refer to such data.

The signal processor can be designed to be static such that as a result of scientific findings respective software modules are filed once in a program storage of the signal processor and remain unchanged. But then if later, for example due to more recent scientific findings, improved algorithms for signal processing are available and these improved algorithms are to be used, the entire implant or implant module which contains the corresponding signal processing unit must be replaced by a new unit comprising the altered operating software by invasive surgery on the patient. This surgery entails renewed medical risks for the patient and is very complex.

This problem can be solved in that, in another embodiment of the invention, a rewritable implantable storage arrangement is assigned to the signal processor for storage and retrieval of an operating program, and at least parts of the operating program are adapted to be at least partially replaced or changed by data transmitted from an external unit via a telemetry means. In this way, after implantation of the implantable system, the operating software as such, inclusive of software for controlling the above described impedance measuring means, can be changed or completely replaced, as is explained for otherwise known systems for rehabilitation of hearing disorders in U.S. Pat. No. 6,198,971.

Preferably, the design is such that, in addition, for fully implantable systems, in the known manner, operating parameters, i.e., patient-specific data, for example, audiological adaptation data, or variable implant system parameters (for example, as a variable in a software program for controlling the impedance measuring means or for control of battery recharging) can be transmitted transcutaneously into the implant after implantation, i.e., wirelessly through the closed skin, and thus, can be changed. Here, preferably, the software modules are designed to be dynamic or re-programmable to provide for an optimum rehabilitation of the respective hearing disorder. In particular, the software modules can be designed to be adaptive, and parameter matching can be done by training by the implant wearer and optionally by using other aids.

Furthermore, the signal processing electronics can contain a software module which achieves stimulation as optimum as possible based on an adaptive neural network. Training of this neural network can take place again by the implant wearer and/or using other external aids.

The storage arrangement for storage of operating parameters and the storage arrangement for storage and retrieval of the operating program can be implemented as storages independent of one another; however there can also be a single storage in which both the operating parameters and also operating programs can be filed.

The subject approach allows matching of the system to circumstances which can be detected only after implantation of the implantable system. Thus, for example, in an at least partially implantable hearing system for rehabilitation of a monaural or binaural inner ear disorder and of a tinnitus by mechanical stimulation of the inner ear, the sensoric (acoustic sensor or microphone) and actoric (output stimulator) biological interfaces are always dependent on anatomic, biological and neurophysiological circumstances, for example on the interindividual healing process. These interface parameters can also be individual, especially time-variant. Thus, for example the transmission behavior of an implanted microphone can vary interindividually and individually as a result of being covered by tissue, and the transmission behavior of an electromechanical transducer which is coupled to the inner ear can vary interindividually and individually in view of different coupling qualities. These differences of interface parameters, which cannot be eliminated or reduced in the devices known from the prior art even by replacing the implant, now can be optimized by changing or improving the signal processing of the implant.

In an at least partially implantable hearing system, it can be advisable or become necessary to implement signal processing algorithms which have been improved after implantation. Especially the following should be mentioned here:

- speech analysis processes (for example, optimization of a fast Fourier transform (FFT)),
- static or adaptive noise detection processes,
- static or adaptive noise suppression processes,
- processes for optimization of the signal to noise ratio within the system,
- optimized signal processing strategies in progressive hearing disorder,
- output level-limiting processes for protection of the patient in case of implant malfunctions or external faulty programming,
- processes of preprocessing of several sensor (microphone) signals, especially for binaural positioning of the sensors,
- processes for binaural processing of two or more sensor signals in binaural sensor positioning, for example optimization of spacial hearing or spacial orientation,
- phase or group delay time optimization in binaural signal processing,
- processes for optimized driving of the output stimulators, especially in the case of binaural positioning of the stimulators.

Among others, the following signal processing algorithms can be implemented with this system even after implantation:

- processes for feedback suppression or reduction,
- processes for optimization of the operating behavior of the output transducer(s) (for example, optimization of the frequency response and phase response, improvement of the impulse response),
- speech signal compression processes for sensorineural hearing loss,
- signal processing methods for recruitment compensation in sensorineural hearing loss.

Furthermore, in implant systems with a secondary power supply unit, i.e., a rechargeable battery system, but also in systems with primary battery supply it can be assumed that these electrical power storage units will enable longer and longer service lives and thus increasing residence times in the patients as technology advances. It can be assumed that fundamental and applied research for signal processing algorithms will make rapid progress. The necessity or the patent desire for operating software adaptation and modification will therefore presumably take place before the service life of the implanted power source expires. The system described here allows this adaptation of the operating programs of the implant even when the implant has already been implanted.

Preferably, there can furthermore be provided a buffer storage arrangement in which data transmitted from the external unit via the telemetry means can be buffered before being relayed to the signal processor. In this way the transmission process from the external unit to the implanted system can be terminated before the data transmitted via the telemetry means are relayed to the signal processor.

Furthermore, there can be provided checking logic which checks the data stored in the buffer storage arrangement before relaying the data to the signal processor. There can be provided a microprocessor module, especially a microcontroller, for control of the signal processor within the implant via a data bus, preferably the checking logic and the buffer storage arrangement being implemented in the microprocessor module, wherein also program parts or entire software modules can be transferred via the data bus and the telemetry means between the outside world, the microprocessor module and the signal processor.

An implantable storage arrangement for storing a working program for the microprocessor module is preferably assigned to the microprocessor module, and at least parts of the working program for the microprocessor module can be changed or replaced by data transmitted from the external unit via the telemetry means.

In another embodiment of the invention, at least two storage areas for storage and retrieval of at least the operating program of the signal processor may be provided. This contributes to the reliability of the system, in that due to the multiple presence of a storage area which contains the operating program(s), for example, after transmission from the exterior or when the implant is turned on, checking for the absence of faults in the software can be done.

Analogously to the above, the buffer storage arrangement can also comprise at least two storage areas for storage and retrieval of data transferred from the external unit via the telemetry means, so that after data transmission from the external unit still in the area of the buffer storage the absence of errors in the transferred data can be checked. The storage areas can be designed for example for complementary filing of the data transferred from the external unit. At least one of the storage areas of the buffer storage arrangement, however, can also be designed to store only part of the data transferred from the external unit, wherein in this case the absence of errors in the transferred data is checked in sections.

Furthermore, to ensure that in case of transmission errors, a new transmission process can be started, a preprogrammed read-only memory area which cannot be overwritten can be assigned to the signal processor, in which ROM area the instructions and parameters necessary for "minimum operation" of the system are stored, for example, instructions which after a "system crash" ensure at least error-free operation of the telemetry means for receiving an operating program and instructions for its storage in the control logic.

As already mentioned, the telemetry means is advantageously designed not only for reception of operating programs from the external unit but also for transfer of operating parameters between the implantable part of the system and the external unit such that on the one hand such parameters (for example the volume) can be adjusted by a physician, a hearing aid acoustics specialist or the wearer of the system himself, and on the other hand the system can also transfer the parameters to the external unit, for example to check the status of the system.

A totally implantable hearing system of the aforementioned type can have on the implant side in addition to the actoric stimulation arrangement and the signal processing unit at least one implantable acoustic sensor and a rechargeable electrical storage element, and in this case a wireless transcutaneous charging device can be provided for charging of the storage element. For a power supply there can also be provided a primary cell or another power supply unit which does not require transcutaneous recharging. This applies especially when it is considered that in the near future, mainly by continuing development of processor technology, a major reduction in power consumption for electronic signal processing can be expected so that for implantable hearing systems new forms of power supply will become usable in practice, for example power supply which uses the Seebeck effect, as is described in U.S. Pat. No. 6,131,581. Preferably, there is also provided a wireless remote control for control of the implant functions by the implant wearer.

In case of a partially implantable hearing system, at least one acoustic sensor, an electronic signal processing arrangement, a power supply unit and a modulator/transmitter unit are contained in an external module which can be worn outside on the body, especially on the head over the implant. The implant comprises the output-side electromechanical transducer and the impedance measuring means, but is passive in terms of energy and receives its operating energy and transducer control data via the modulator/transmitter unit in the external module.

The described system can be designed to be monaural or binaural for the fully implantable design as well as for the partially implantable design. A binaural system for rehabilitation of a hearing disorder of both ears has two system units which each are assigned to one of the two ears. In doing so the two system units can be essentially identical to one another. However, one of the system units can also be designed as a master unit and the other system unit as a slave unit which is controlled by the master unit. The signal processing modules of the two system units can communicate with one another in any way, especially via a wired implantable line connection or via a wireless connection, preferably a bidirectional high frequency path, a ultrasonic path coupled by bone conduction, or a data transmission path which uses the electrical conductivity of the tissue of the implant wearer such that in both system units optimized binaural signal processing and transducer array control are achieved.

These and further objects, features and advantages of the present invention will become apparent from the following description when taken in connection with the accompanying drawings which, for purposes of illustration only, shows several embodiments in accordance with the present invention.

DETAILED DESCRIPTION OF THE INVENTION

Figure 1:
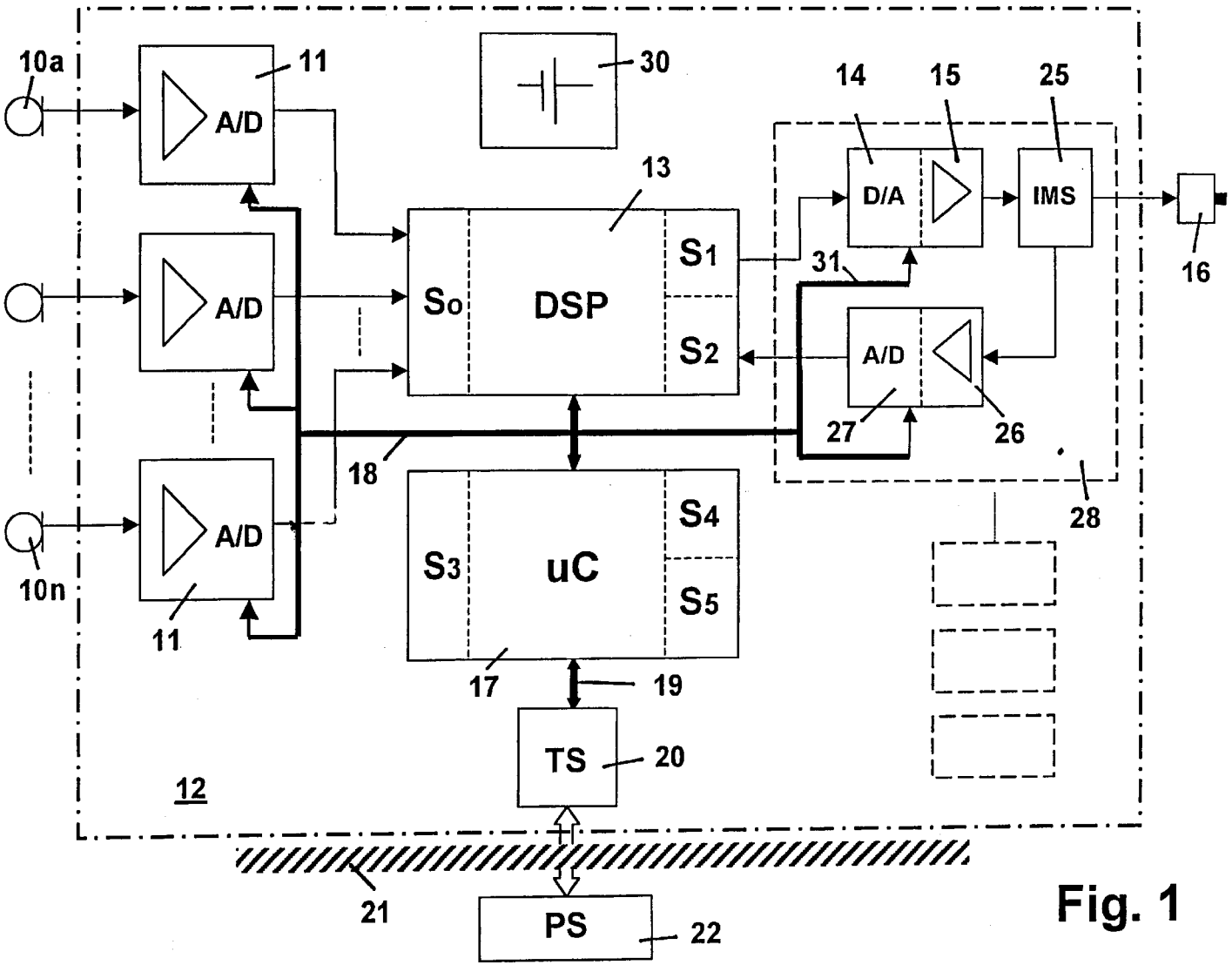
FIG. 1 shows a block diagram of a fully implantable hearing system for rehabilitation of a middle ear and/or inner ear disorder and/or of a tinnitus, the system including means for measuring the electrical transducer impedance.

In the case of the fully implantable hearing system of FIG. 1 the external acoustic signal is received via one or more acoustic sensors (microphones) 10*a* to 10*n* and is converted into electrical signals. In the case of an implant for exclusive rehabilitation of tinnitus by masking or noiser functions without additional hearing aid function, these sensor functions are eliminated. The electrical sensor signals are routed to a unit 11 which is part of an implantable electronic module 12 in which the sensor signal or signals are selected, preprocessed and converted into digital signals (A/D conversion). This preprocessing can consist, for example, of an analog linear or nonlinear preamplification and filtering (for example anti-aliasing filtering). The digitized sensor signal(s) are supplied to a digital signal processor 13 (DSP) which executes the intended function of the hearing implant, for example, audio signal processing in a system for inner ear hearing disorders and/or signal generation in the case of a tinnitus masker or noiser. The signal processor 13 contains a read only memory area $S_0$ which cannot be overwritten and in which the instructions and parameters necessary for "minimum operation" of the system are stored. The signal processor 13 also contains a storage area $S_1$ in which the operating software of the intended function or functions of the implant system are filed. Preferably, this storage area is be present twice ($S_1$ and $S_2$). The rewritable program storage for holding the operating software can be based on EEPROM or RAM cells, and in this case provisions should be made for this RAM area to always be "buffered" by the power supply system within the implant.

The digital output signals of the signal processor 13 are converted in a digital to analog converter 14 (D/A) into analog signals. There can be more than one D/A converter, depending on the implant function. Alternatively, the D/A connector can be completely eliminated if, for example, in the case of a hearing system with an electromagnetic output converter, a pulse-width modulated, serial digital output signal of the signal processor 13 is transferred directly to the output transducer. The analog output signal of the digital to analog converter 14 is then routed to a driver unit 15 which, depending on the implant function, triggers an electromechanical output transducer 16 for stimulation of the middle or inner ear, respectively.

In the embodiment shown in FIG. 1, the signal processing components 11 and 13 are controlled, via a bidirectional data bus 18, by a microcontroller 17 ($\mu$C) having one or two associated storages $S_4$ and $S_5$, respectively. In the storage area(s) $S_4$ and $S_5$, respectively, particularly the operating software portions of the implant management system can be filed, such as for example administration, monitoring and telemetry functions. Memories $S_1$ and/or $S_2$ can also file patient-specific parameters, for example audiological adaptation parameters, which can be altered from the outside. Furthermore, the microcontroller 17 has a rewritable storage $S_3$ in which a working program for the microcontroller 17 is filed.

The microcontroller 17 communicates via a data bus 19 with a telemetry system 20 (TS). This in turn communicates bidirectionally wirelessly through the closed skin 21, by way of example via an inductive coil coupling not shown in FIG. 1, with an external programming system 22 (PS). The programming system 22 advantageously can be a PC-based system with the corresponding programming, processing, display and administration software. The operating software of the implant system which is to be changed or completely replaced is transmitted via this telemetry interface, and at first is buffered in the storage area $S_4$ and/or $S_5$ of the microcontroller 17. The storage area $S_5$ may be used for example for complementary filing of the data transferred from the external system, and a simple verification of the software transmission by a reading operation may be carried out via the telemetry interface to check coincidence of the contents of storage areas $S_4$ and $S_5$ before changing or replacing the content of the rewritable storage $S_3$.

The operating software of the at least partially implantable hearing system presently is to be understood to include both the operating software of the microcontroller 17 (for example housekeeping functions such as energy management or telemetry functions) as well as the operating software of the digital signal processor 13. Thus, for example, simple verification of software transmission can be done by a reading process via the telemetry interface before the operating software, or the corresponding signal processing portions of this software, are transmitted into the program storage area $S_1$ of the digital signal processor 13 via the data bus 18. Furthermore, the working program for the microcontroller 17, stored for example in the rewritable storage $S_3$, can be changed or replaced in whole or in part via the telemetry interface 20 using the external unit 22.

Connected to the digital to analog converter 14 and driver unit 15, the latter being adapted to the respective transducer principle of output transducer 16, is a measuring system 25 (IMS) for analog measurement of the electrical transducer impedance. The analog measuring data supplied by the measuring system 25 are amplified by a measuring amplifier 26 and are converted into digital measurement data by an associated analog to digital converter 27 (A/D). The digital measurement data are transmitted to the digital signal processor 13 of the hearing system for further processing and/or storing. This driver and impedance measuring system, to which the electromechanical output transducer 16 is associated, is shown in FIG. 1 as unit 28. The impedance measurement data may be transmitted to the external programming and display system 22 (for example a personal computer having a corresponding hardware interface) via the microcontroller 17 and telemetry unit 20.

When the implantable hearing system comprises a plurality of electromechanical output transducers, a corresponding plurality of units 28 is to be provided for, as schematically indicated with broken lines in FIG. 1. In such a case, the respective impedance measurement data are made available to the digital signal processor 13 via a corresponding digital data bus structure (not shown in FIG. 1).

All electronic components of the implant system are supplied with electrical operating energy by a primary or secondary battery 30.

Figure 2:
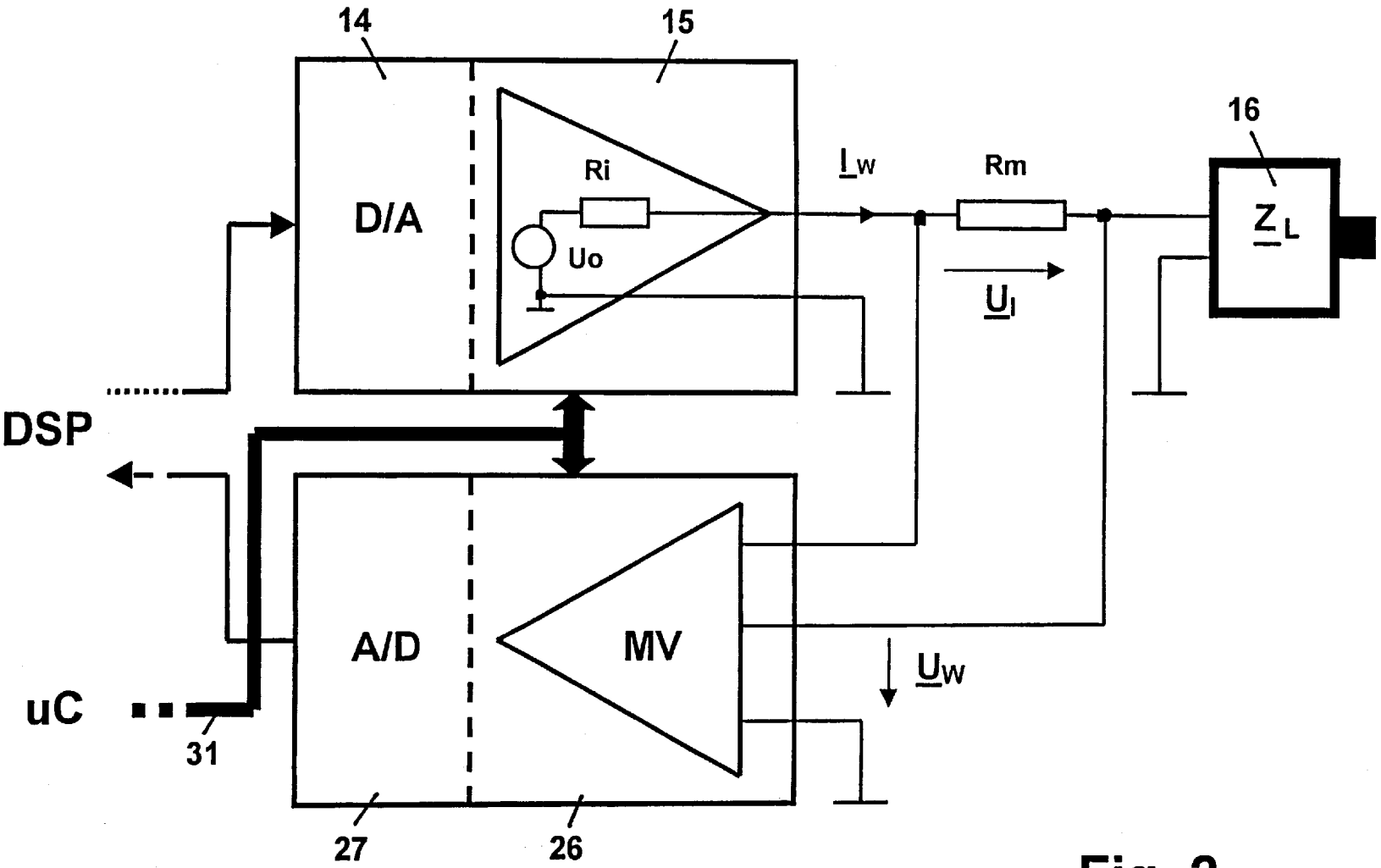
FIG. 2 shows an embodiment of an impedance measuring system for a transducer channel according to FIG. 1.

FIG. 2 shows a simple embodiment of the impedance measurement system 25 for one transducer channel according to FIG. 1. The digital driver data for the electromechanical transducer 16 coming from digital signal processor 13 are converted into an analog signal by the digital to analog converter 14 and are supplied to the transducer driver 15. In the subject embodiment, the output of driver 15 is illustrated as a voltage source $U_o$ having the internal resistance $R_i$. The analog output signal of driver 15 is sent, via a measuring resistance $R_m$, to the electromechanical transducer 16 which has a complex electrical impedance $Z_L$.

When the sum of $R_m$ and of the absolute value of $Z_L$ is large with respect to $R_i$, voltage is impressed on the electromechanical transducer 16. When the voltage drop across $R_m$ is picked up by the illustrated measuring amplifier 26 in a floating and high impedance manner, a measuring voltage $U_I$ is available which is proportional to the transducer current $I_w$. At the same time, the transducer terminal voltage $U_W$ is available to the measuring amplifier 26. After a corresponding analog to digital conversion of these measuring voltages in analog to digital converter 27, both data sets are available in digital form to the digital signal processor 13. Thus it is possible to determine the complex electrical transducer impedance $Z_L=U_w/I_w$ as to magnitude and phase by formation of the corresponding quotient. The respective basic functions of the driver and impedance measuring unit 28 are set by microcontroller 17 via a digital control bus 31.

Figure 3:
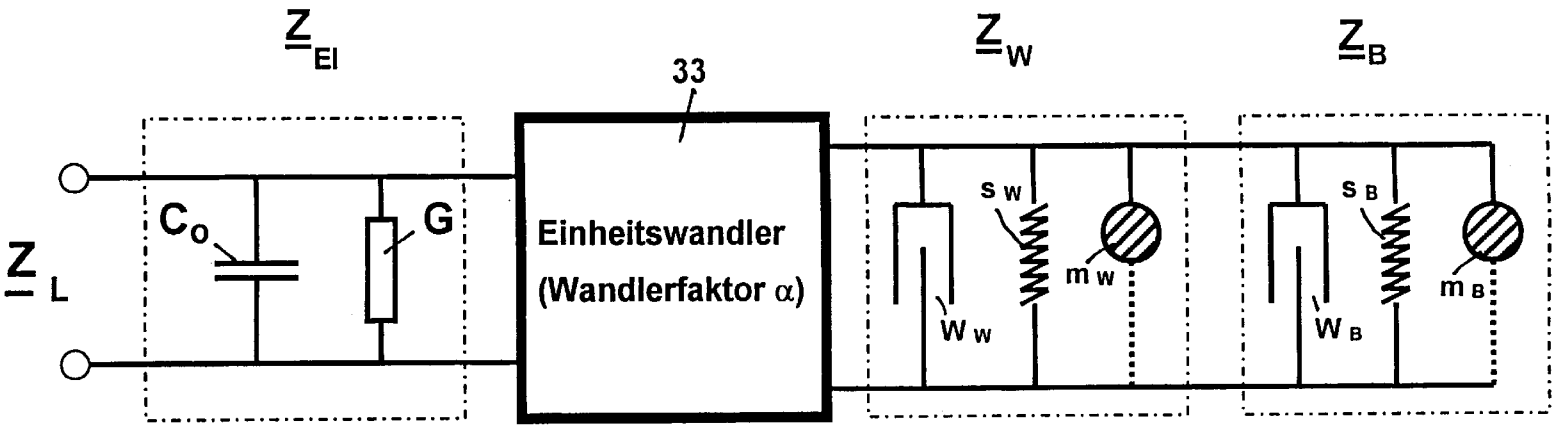
FIG. 3 shows an electromechanical equivalent circuit diagram approximating a piezoelectric output transducer and biological load components coupled thereto.

FIG. 3 shows an electromechanical equivalent circuit diagram approximating a piezoelectric output transducer and biological load components coupled thereto. The piezoelectric transducer is determined at the electrical impedance side $Z_{El}$ essentially by a quiescent capacity $C_o$ and a leakage conductance G. An electromechanical unit transducer 33 having an electromechanical transducer factor $\alpha$ is followed by the mechanical components of the transducer itself, which represent the mechanical impedance $Z_W$. When a piezoelectric transducer is operated in a high-frequency mode, i.e. when the first mechanical resonance frequency is disposed at the upper end of the spectral transmission range, as discussed in more detail in U.S. Pat. No. 5,277,694, the mechanical transducer impedance $Z_W$ is properly determined in conformance with a first approximation by the mechanical components: dynamic transducer mass $m_W$, transducer stiffness $s_W$ and the frictional transducer resistance (real proportion) $W_W$. The biological mechanical load impedance $Z_B$ in the subject example likewise is approximated by the three mechanical impedance components: mass $m_B$ (for example the mass of a middle ear ossicle), stiffness $s_B$ (for example the stiffness of the tensioning annular band of the stapes footplate in the oval window) and frictional resistance $W_B$ (for example fibrous tissue at the coupling site). Under the assumption that at the side of the mechanical load the transducer components as well as the biological load components have the same velocity (mechanical parallel connection), an electrical equivalent circuit diagram as shown in FIG. 4 is obtained upon transformation of the mechanical components by the unit transducer 33 onto the electrical side.

Figure 4:
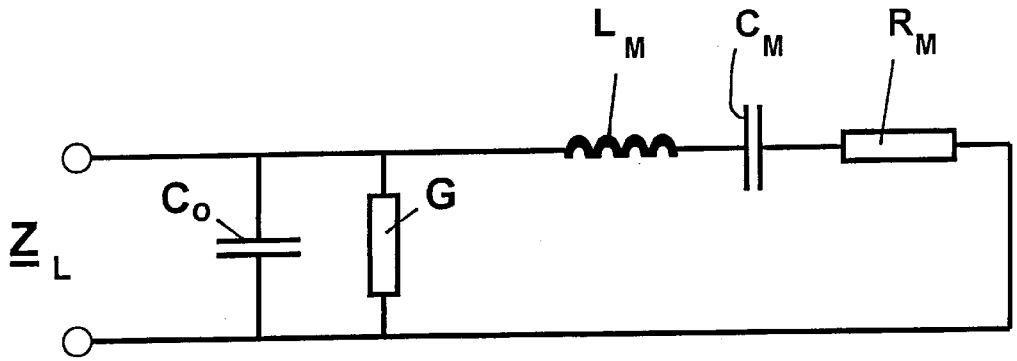
FIG. 4 shows an equivalent circuit diagram of the electrical transducer impedance $Z_L$ according to FIG. 3.

FIG. 4 shows the equivalent circuit diagram of the electrical transducer impedance $Z_L$ according to FIG. 3, wherein die inductivity $L_M$ reflects the sum of the masses $m_W$ and $m_B$, the capacity $C_M$ represents the mechanical parallel connection of the stiffnesses $s_W$ and $s_B$, and the resistance $R_M$ corresponds to the mechanical parallel connection of the components $W_W$ and $W_B$.

Figure 5:
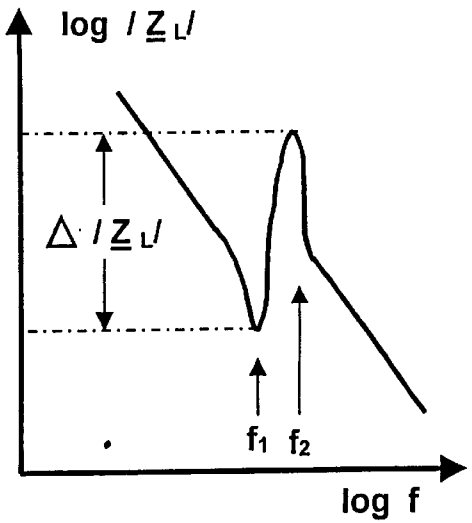
FIG. 5 shows the dependency of the absolute value of the electrical transducer impedance $/Z_L/$ on the frequency f according to FIG. 4 in double-logarithmic representation.

FIG. 5 shows the dependency of the absolute value of the electrical transducer impedance $|Z_L|$ on the frequency f according to FIG. 4 in double-logarithmic representation. The basically capacitive course of $/Z_L/$ determined by $C_o$ is to be recognized. The series resonance occurring at $f_1$ and the parallel resonance occurring at $f_2$ are determined by the components $L_M$ and $C_M$ together with $C_o$. The value $\Delta|Z_L|$ gives information about the mechanical oscillation Q. Therefore very accurate information about the quality of the coupling and about postoperative changes thereof can be gained from the spectral positions of $f_1$ and $f_2$ and from the value $\Delta/Z_L/$, particularly when the impedance measurements represent the entire spectral range and the entire level range of the hearing implant.

Figure 6:
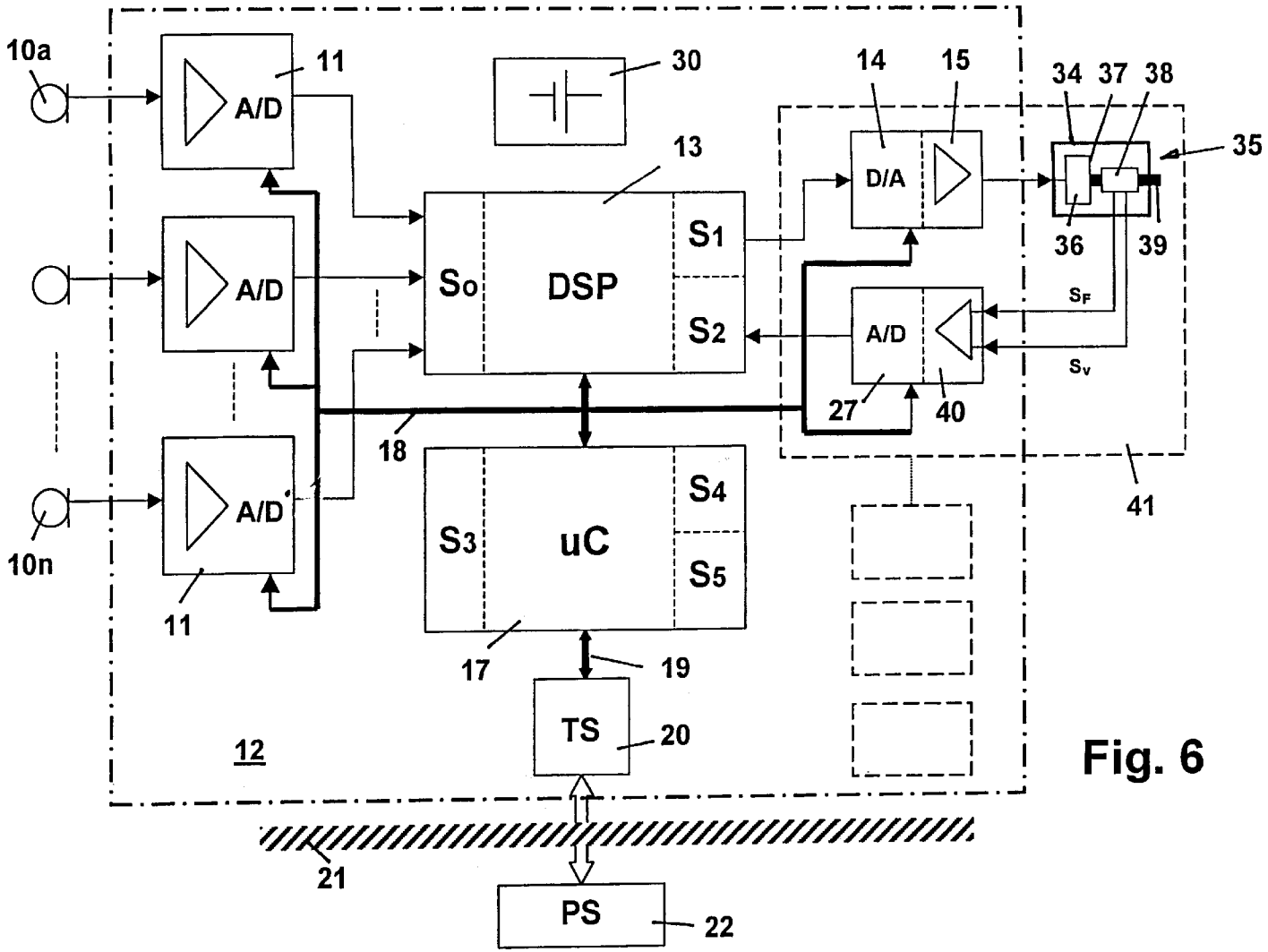
FIG. 6 shows an embodiment of a fully implantable hearing system with direct mechanical impedance measurement.

FIG. 6 shows a fully implantable hearing system substantially similar to the system of FIG. 1, however modified for a direct measurement of the mechanical impedance. Connected to the digital to analog converter 14 and to the driver amplifier 15, which is adapted to the transducer principle used, is a unit 35 which is received in a housing 34 and which includes an a electromechanical output transducer 36 having an electromechanically active element 37, for example a piezoelectric and/or electromagnetic system. A mechanical impedance measuring system 38 is integrated at the actoric output side into the transducer 36. The impedance measuring system 38, in the implanted state, measures the magnitude and phase of the force F acting on the coupled biological load structure and of the velocity v of a coupling element 39. The biological load structure is not shown.

The impedance measuring system 38 supplies electrical, analog measuring signals $S_F$ and $S_v$, which are proportional to the force F and the velocity v, respectively. These analog measuring signals are converted into digital measuring data by a two-channel measuring amplifier 40 with multiplexer function and the associated analog to digital converter 27, and they are routed to the digital signal processor 13 of the hearing system for further processing and/or storing. The formation of the complex mechanical impedance Z (f, P)=F/v as a function of the frequency f and of the measuring level P can be accomplished by either an analog computer provided in the measuring amplifier 40 or, upon a corresponding software-based analog to digital conversion, in the digital signal processor 13. This driver- and impedance measuring system with associated electromechanical transducer 36 is represented as a unit 41 in a box drawn with interrupted lines. The impedance measuring data may be transmitted to the external programming and display system 22 (for example a personal computer with corresponding hardware interface) via the microcontroller 17 and the telemetry unit 20.

When the implantable hearing system comprises a plurality of electromechanical transducers 36, each transducer is to be supplemented by a unit 41 as likewise indicated by broken lines in FIG. 6. The respective impedance measuring data then are made available to the digital signal processor 13 via a corresponding digital data bus structure (not further illustrated in FIG. 6).

The other components of the hearing system of FIG. 6 correspond to those of FIG. 1 and therefore do not require any further explanation.

Figure 7:
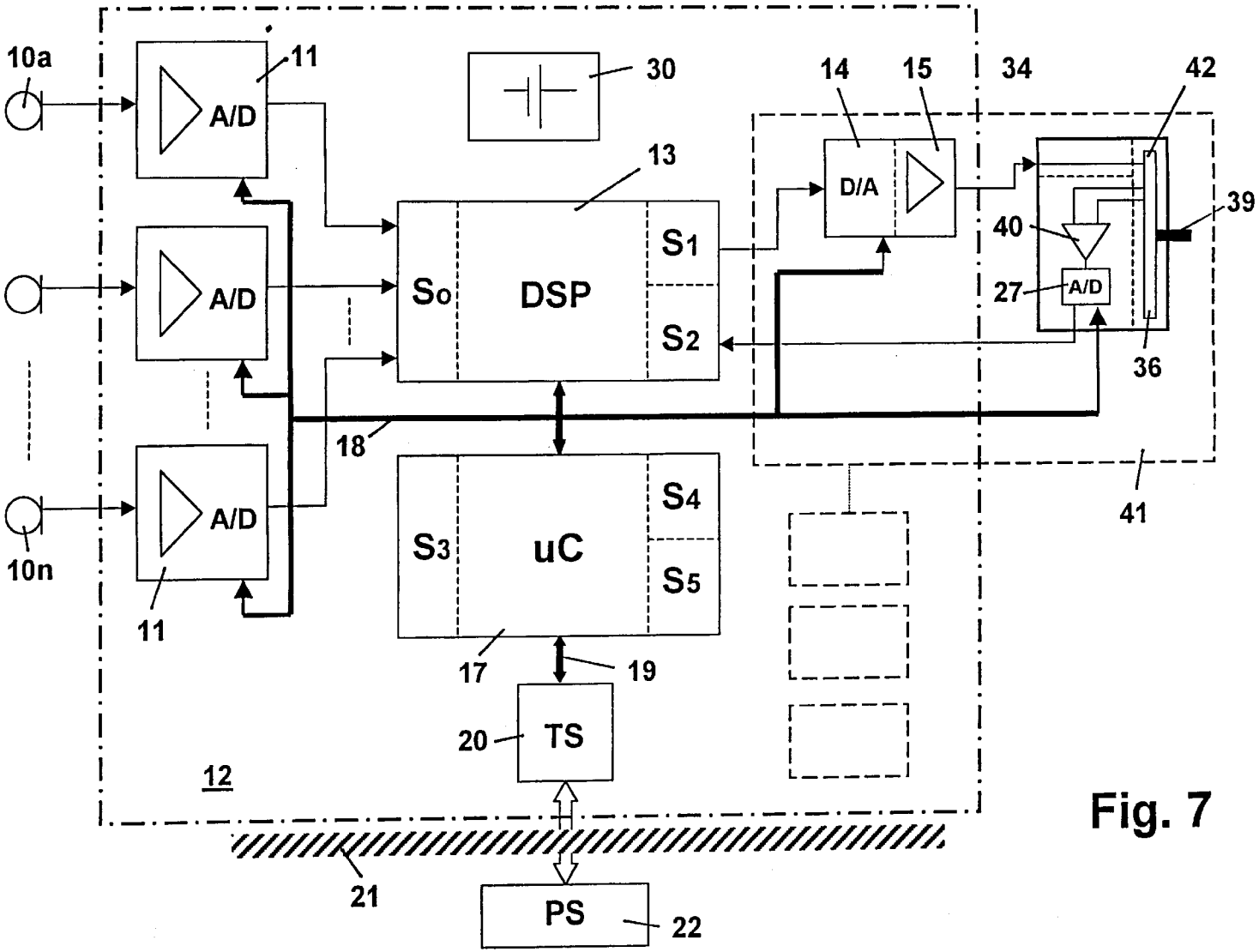
FIG. 7 shows a further embodiment of a fully implantable hearing system with direct mechanical impedance measurement.

FIG. 7 shows a fully implantable hearing system with direct measurement of the mechanical impedance in conformity with FIG. 6, wherein the corresponding two-channel measuring amplifier 40 with multiplexer function and the associated analog to digital converter 27 for detecting the force and velocity signals are integrated into the housing 34 of unit 35. The electromechanically active element of the transducer 36 and the measuring system for determining the mechanical load impedance are commonly represented here as element 42. The element for coupling the transducer 36 to the biological load again is indicated at 39.

The structure and the mode of operation of the system of FIG. 7 otherwise correspond to those of the system of FIG. 6.

Figure 8:
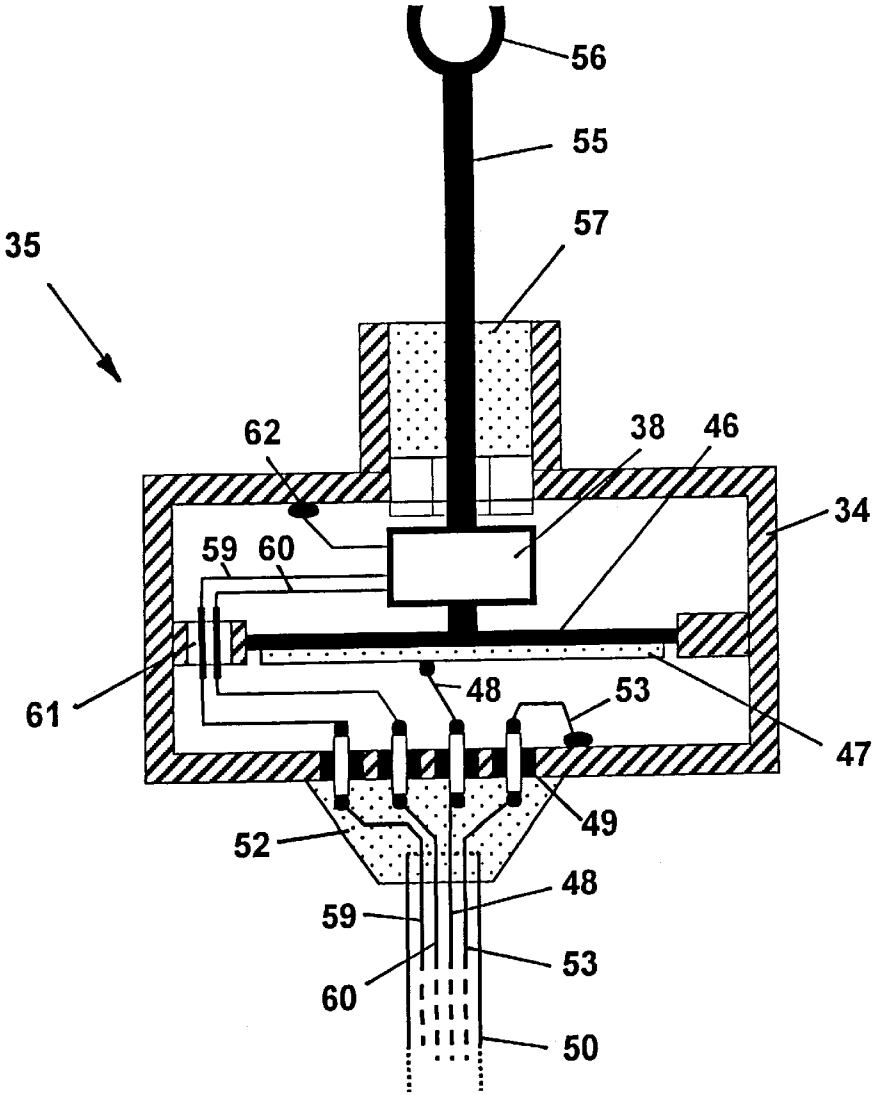
FIG. 8 shows an embodiment of a piezoelectric transducer system provided with a measuring system for measuring the mechanical impedance in conformity with FIG. 6.

FIG. 8 shows an embodiment of the unit 35 of FIG. 6 comprising a piezoelectric transducer system in conformity with U.S. Pat. No. 5,277,694 and additionally a measuring system for determining the mechanical impedance. The unit 35 illustrated in FIG. 8 is provided with a biocompatible cylindrical housing 34 of electrically conductive material, such as titanium. The housing 34 is filled with an inert gas. An electrically conductive membrane 46 of electromechanical output transducer 36 that can oscillate, is disposed within the housing 34. The membrane 46 preferably is circular, and it is fixedly connected to housing 34 at the outer edge thereof. A thin disk 47 of piezoelectric material, e.g. lead-zirconate-titanate (PTZ), is provided at the side of membrane 46, which in FIG. 8 is the underside. The side of the piezoelectric disk 47 facing membrane 46 is in electrically conductive connection with membrane 46, preferably via an electrically conductive adhesive connection. The piezoelectric disk 47 is contacted, at the side thereof remote from membrane 46, with a thin flexible wire which is part of a signal line 48 and which in turn is connected via a hermetically sealed housing lead-through connector 49 to a transducer line 50 which is disposed outside of housing 34. A polymer sealing between the outer side of housing 34, the housing lead-through connector 49 and the transducer line 50 is shown in FIG. 8 at 52. A ground terminal 53 extends from transducer line 50 via the housing lead-through connector 49 to the inner side of housing 34.

Application of an electrical voltage between the signal line 48 and the ground terminal 53 results in a deformation of the hetero-compound consisting of membrane 46 and piezoelectric disk 47, and thus in a deflection of membrane 46. Further particulars of such a piezoelectric transducer which may be utilized in the present system, too, are described in commonly owned U.S. Pat. No. 5,277,694 which is hereby incorporated by reference. Such an electromechanical output transducer 36 typically has a relatively high mechanical output impedance, particularly a mechanical output impedance which is higher than the mechanical load impedance of the biological structure of the middle ear and/or the inner ear coupled to the transducer in the implanted state.

In the illustrated embodiment a coupling rod 55 and a passive coupling element 56 are provided to connect the transducer 36 to any desired middle ear ossicle. The passive coupling element 56 is attached to the end of coupling rod 55 remote from transducer 36 or is defined by this end of the coupling rod. The coupling of the output side of transducer 36 to the biological load structure takes place via mechanical impedance measuring system 38 which is in mechanical connection with the side of membrane 46 which in FIG. 1 is the upper side of membrane 46; preferably the connection is with the center of the membrane. The impedance measuring system 38, with its end facing the membrane 46, may directly engage membrane 46, and with its other end, may engage the end of coupling rod 55 facing the membrane; however, impedance measuring system 38 also may be integrated into coupling rod 55.

In the illustrated embodiment coupling rod 55 extends at least approximately normal to membrane 46 from the outside into the interior of housing 34 through an elastically resilient polymer sealing 57. The polymer sealing 57 is designed such as to permit in the implanted state axial oscillations of the coupling rod 55.

The impedance measuring system 38 is disposed within housing 34. The analog measuring signals SF and SV are transmitted from the impedance measuring system 38 via measuring conduits 59, 60, lead-through connectors 61 within the housing and the housing lead-through connector 49 to the transducer line 50. The impedance measuring system 38 further is in electrically conductive connection via a ground terminal with housing 34 and via this housing with the ground terminal 53. Thus the reference potential of the two measuring signals $S_F$ and $S_V$ for force and velocity is the transducer housing 34. When, in conformity with a preferred embodiment, the impedance measuring system 38 itself is based on piezoelectric transducers and therefore active electrical impedance converters are required in the measuring system, the latter may be supplied via electric phantom feed means with operating energy from the electronic module 12 of the implantable hearing system through one of the two implant measuring line 59, 60 for force or velocity.

Figure 9:
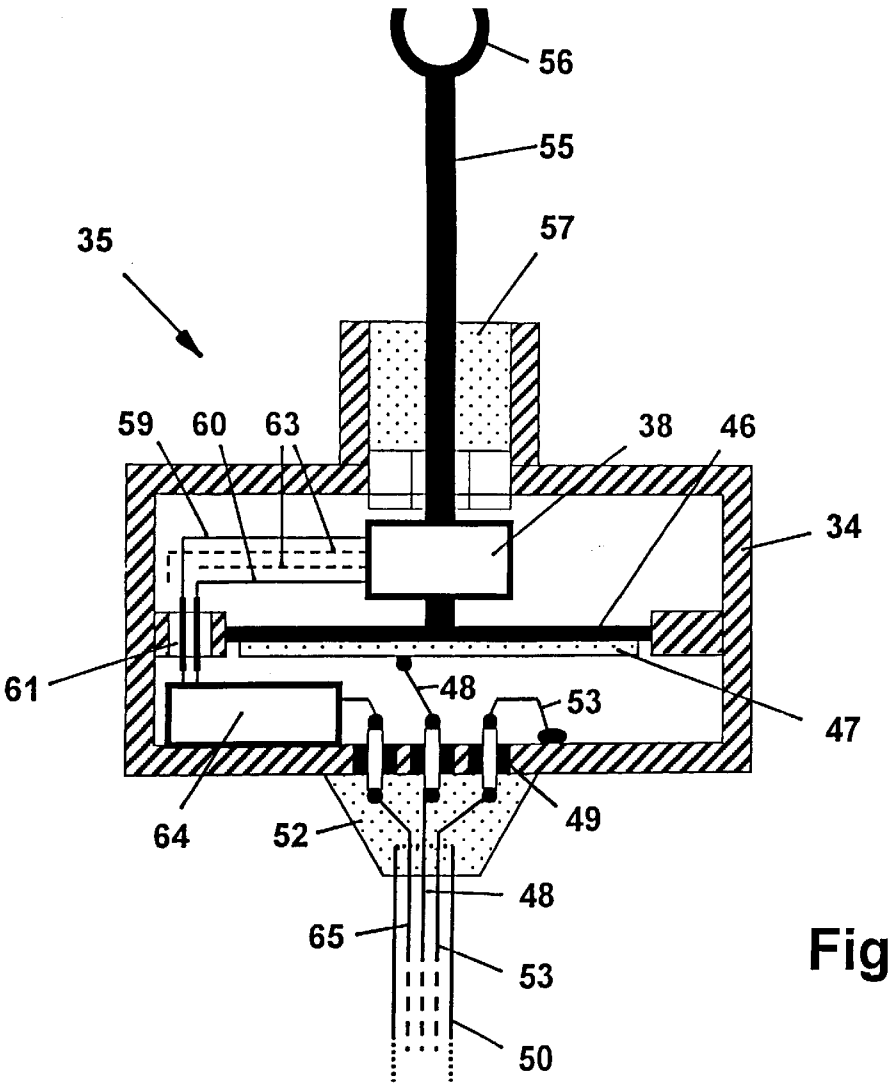
FIG. 9 shows an embodiment of a piezoelectric transducer system provided with a measuring system for measuring the mechanical impedance in conformity with FIG. 7.

FIG. 9 shows an embodiment of a piezoelectric transducer system provided with a measuring system for determining the mechanical impedance in conformity with FIG. 7, wherein in this embodiment the measuring amplifier 40 and the associated analog to digital converter 27 are disposed within the transducer housing 34 in a separate electronic module 64 which is connected via lines 63. The impedance measuring system 38 and the separate electronic module 64 may be supplied via electric phantom feed means with operating energy from the electronic module 12 of the implantable hearing system through one of two active implant lines (signal line 48 for the actor driver signal or a signal line 65 for the digital output signal of the analog to digital converter).

Figure 10:
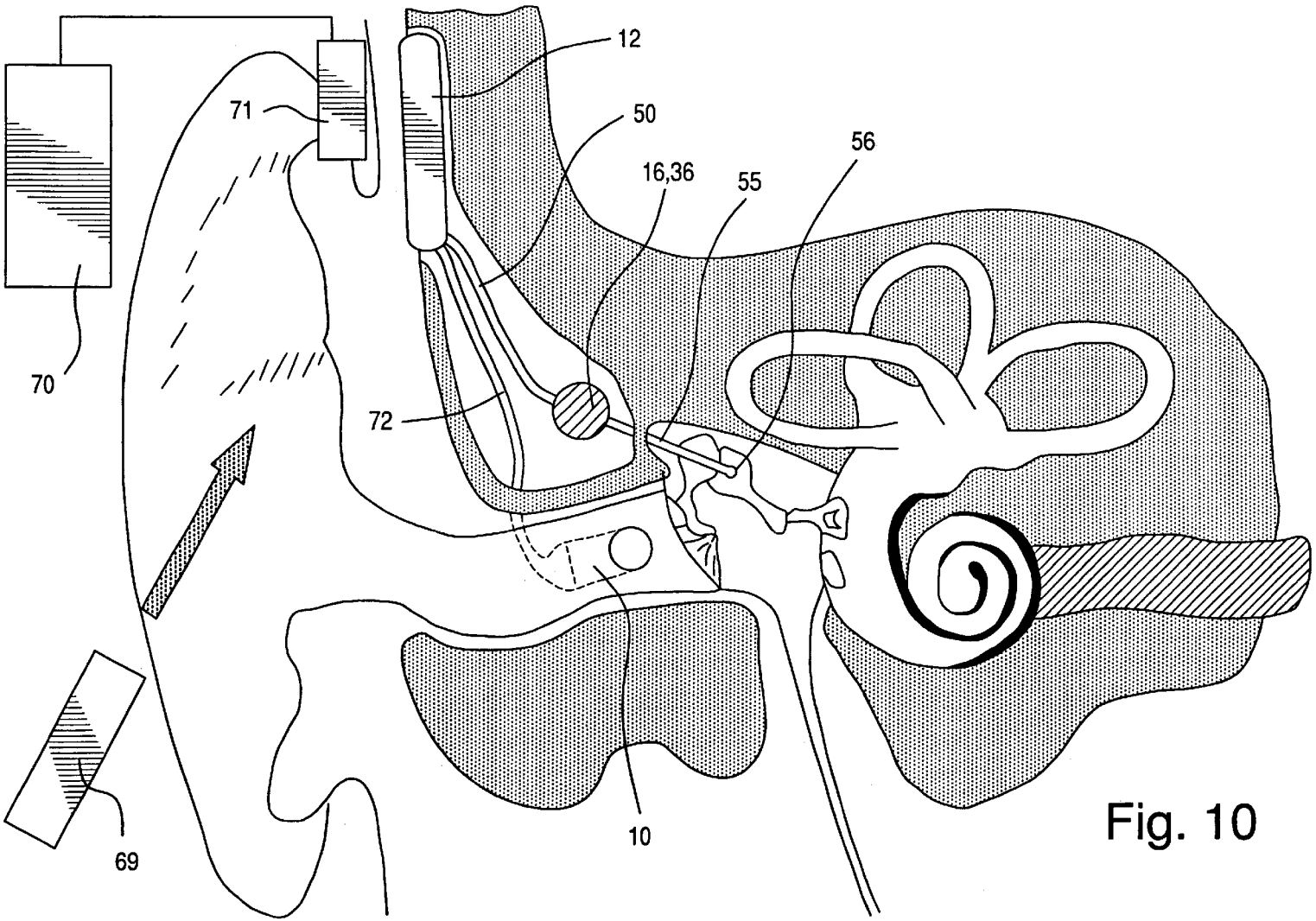
FIG. 10 shows an embodiment of a fully implantable hearing system in conformity with the invention.

FIG. 10 schematically shows the structure of a fully implantable hearing system provided with actoric stimulation means in form of an electromechanical output transducer 16 or 36, for example the transducer according to FIG. 8 or FIG. 9. The electromechanical output transducer generally may be designed as any electromagnetic, electrodynamic, piezoelectric, magnetostrictive or dielectric (capacitive) transducer. The transducer illustrated in FIGS. 8 and 9, amongst others, may be modified in the manner explained in commonly owned U.S. Patent No. 6,123,660, which is hereby incorporated by reference, such that a permanent magnet is attached at the side of the piezoelectric ceramic disk 47 which in FIGS. 8 and 9 is the underside, which permanent magnet cooperates with an electromagnetic coil in the manner of an electromagnetic transducer. Such a combined piezoelectric-electromagnetic transducer is of advantage particularly with respect to a broad frequency band and to attain relatively high oscillation amplitudes at relatively small amounts of supplied energy. The electromechanical output transducer further may be an electromagnetic transducer of the type described in commonly owned U.S. Pat. No. 6,162,169 which is hereby incorporated by reference. In any case, the presently described measuring system 25 or 38 additionally is provided for.

To couple the electromechanical transducer 16 or 36 to the middle ear or the inner ear, especially coupling arrangements as described in commonly owned U.S. Pat. No. 5,941,814, which is hereby incorporated by reference, are suited in which a coupling element, in addition to a coupling part for the pertinent coupling site, has a crimp sleeve which is first slipped loosely onto a rod-shaped part of a coupling rod connected to the transducer in the above described manner. This rod-shaped part of the coupling rod is provided with a rough surface. During implantation, the crimp sleeve can simply be pushed and turned relative to the coupling rod to exactly align the coupling part of the coupling element with the intended coupling site. Then, the crimp sleeve is fixed by being plastically cold-deformed by means of a crimping tool. Alternatively, the coupling element can be fixed with reference to the coupling rod by means of a belt loop which can be tightened.

Other coupling arrangements which can be preferably used here are described, in particular, in commonly owned, co-pending U.S. patent applications Ser. Nos. 09/576,009, 09/626,745, 09/613,560, 09/680,489 and 09/680,488, all of which hereby are incorporated by reference. Thus, according to commonly owned, co-pending U.S. patent application Ser. No. 09/576,009, a coupling element can have a contact surface on its coupling end which has a surface shape which is matched to or can be matched to the surface shape of the coupling site, and has a surface composition and surface size such that, by placing the coupling end against the coupling site, dynamic tension-compression force coupling of the coupling element and ossicular chain occur due to surface adhesion which is sufficient for secure mutual connection of the coupling element and the ossicular chain.

The coupling element can be provided with an attenuation element which adjoins the coupling site, in the implanted state, with entropy-elastic properties in order to achieve the optimum form of vibration of the footplate of the stapes or of the membrane which closes the round window or an artificial window in the cochlea, in the vestibulum or in the labyrinth, and especially to minimize the risk of damage to the natural structures in the area of the coupling site during and after implantation (see commonly owned, co-pending U.S. patent application Ser. No. 09/626,745).

According to commonly owned co-pending U.S. patent application Ser. No. 09/613,560 the coupling element can be provided with an actuation device for selectively moving the coupling element between an open position, in which the coupling element can engage and disengage the coupling site, and a closed positioning, in which the coupling element in the implanted state is connected by force-fit and/or form-fit to the coupling site.

Furthermore, for mechanically coupling the electromechanical transducer to a pre-selected coupling site on the ossicular chain, a coupling arrangement (see commonly owned, co-pending U.S. patent application Ser. No. 09/680,489) is suitable which has a coupling rod which can be caused by the transducer to mechanically vibrate, and a coupling element which can be connected to the pre-selected coupling site. The coupling rod and the coupling element are interconnected by at least one coupling, and at least one section of the coupling element which, in the implanted state, adjoins the coupling site is designed for low-loss delivery of vibrations to the coupling site, the first half of the coupling having an outside contour with at least roughly the shape of a spherical dome which can be accommodated in the inside contour of a second coupling half that is at least partially complementary to the outside contour. The coupling has the capacity to swivel and/or turn reversibly against forces of friction, but is essentially rigid for the dynamic forces which occur in the implanted state.

According to a modified embodiment of such a coupling arrangement (see commonly owned, co-pending U.S. patent application Ser. No. 09/680,488) the first half of the coupling has an outside contour with an at least cylindrical, preferably circularly cylindrical, shape which can be accommodated in the inside contour of a second coupling half that is at least partially complementary to the outside contour. A section of the coupling element, which adjoins the coupling site in the implanted state, is designed for low-loss delivery of vibrations to the coupling site in the implanted state, transmission of dynamic forces between the two halves of the coupling taking place essentially in the direction of the lengthwise axis of the first coupling half. The coupling can be reversibly coupled and de-coupled, and can be reversibly moved linearly and/or rotationally with reference to the lengthwise axis of the first coupling half, but is rigid for the dynamic forces which occur in the implanted state.

The fully implantable hearing system shown in FIG. 10 further comprises an implantable microphone (sound sensor) 10, a wireless remote control 69 to control the implant functions by the implant wearer, and a charging system comprising a charger 70 and a charging coil 71 for wireless transcutaneous recharging of the secondary battery 30 (FIGS. 1, 6 and 7) located in the implant for power supply of the hearing system.

The microphone 10 can advantageously be built in the manner known from commonly owned U.S. Pat. No. 5,814,095 which hereby is incorporated by reference. Particularly, microphone 10 can be provided with a microphone capsule which is accommodated hermetically sealed on all sides within a housing, and with an electrical feed-through connector for routing at least one electrical connection from within the housing to the outside thereof The housing has at least two legs which are arranged at an angle relative to one another, a first one of the legs containing the microphone capsule and being provided with a sound inlet membrane, and a second one of the legs containing the electrical feed-through connector and being set back relative to the plane of the sound inlet membrane. The geometry of the microphone housing is chosen such that when the microphone is implanted in the mastoid cavity the leg which contains the sound inlet membrane projects from the mastoid into an artificial hole in the posterior bony wall of the auditory canal and the sound inlet membrane touches the skin of the wall of the auditory canal. To fix the implanted microphone 10, there can preferably be a fixation element of the type known from commonly owned U.S. Pat. No. 5,999,632 which hereby is incorporated by reference. This fixation element has a sleeve, a cylindrical housing part of which surrounds the leg which contains the sound inlet membrane, wherein the sleeve is provided with projecting, elastic flange parts which can be placed against the side of the wall of the auditory canal facing the skin of the auditory canal. The fixation element preferably comprises a holding device which, before implantation, maintains the flange parts mentioned above, against the elastic restoration force of the flange parts, in a bent position which allows insertion through the hole of the wall of the auditory canal.

The charging coil 71 connected to the output of the charging device 70 preferably forms part of the transmitting serial resonant circuit in the manner known from commonly owned U.S. Pat. No. 5,279,292 which hereby is incorporated by reference. The transmitting serial resonant circuit can be inductively coupled to a receiving serial resonant circuit which is not shown. The receiving serial resonant circuit can be part of the implantable electronic module 12 (as shown in FIGS. 1, 6 and 7), and according to U.S. Pat. No. 5,279,292, can form a constant current source for the battery 30. The receiving serial resonant circuit is connected in a battery charging circuit which, depending on the respective phase of the charging current flowing in the charging circuit, is closed via one branch or the other of a full wave rectifier bridge.

The electronic module 12 is connected in the arrangement as shown in FIG. 10 via a microphone line 72 to the microphone 10 and via the transducer line 50 to the electromechanical transducer 16 or 36, respectively, and to measuring system 25 or 38, respectively.

Figure 11:
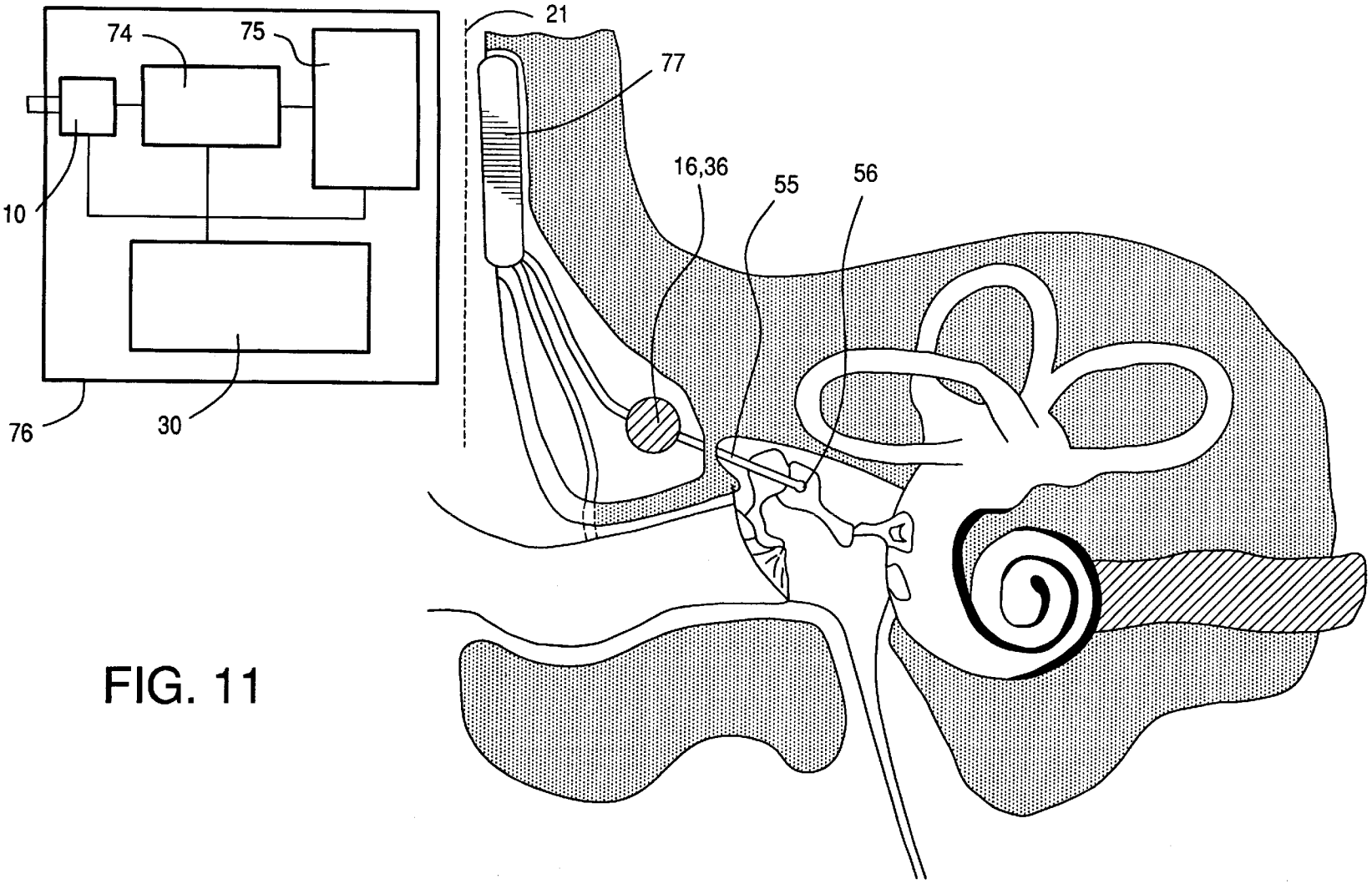
FIG. 11 shows an embodiment of a partially implantable hearing system in conformity with the invention.

FIG. 11 schematically shows the structure of a partially implantable hearing system. This partially implantable system includes a microphone 10, an electronic module 74 for electronic signal processing for the most part according to FIGS. 1, 6 or 7 (but without the telemetry system 20), the power supply (battery) 30 and a modulator/transmitter unit 75 in an external module 76 which is to be worn externally on the body, preferably on the head over the implant. As in known partial implants, the implant is passive in terms of energy. Its electronic module 77 (without the battery 30) receives its operating energy and control signals for the transducer 16 or 36 and the measuring system 25 or 38 via the modulator/transmitter unit 75 in the external part 76. The electronic module 77 and the modulator/transmitter unit 75 include the necessary telemetry unit for transmission of the impedance measuring data to the external module 76 for further evaluation.

Both the fully implantable hearing system and the partially implantable hearing system may be designed as a monaural system (as illustrated in FIGS. 10 and 11) or as a binaural system. A binaural system for rehabilitation of a hearing disorder of both ears comprises a pair of system units, each of which units is associated to one of the two ears. Both system units may be essentially identical to one another. But one system unit can also be designed as a master unit and the other system unit as the slave unit which is controlled by the master unit. The signal processing modules of the two system units can communicate with one another in any way, especially via a wired implantable line connection or via a wireless connection, preferably a bidirectional high frequency path, a bodyborne sound-coupled ultrasonic path or a data transmission path which uses the electrical conductivity of the tissue of the implant wearer, such that in both system units optimized binaural signal processing is achieved.

Particularly, the following possibilities of combinations are possible:

Both electronic modules may each contain a digital signal processor according to the aforementioned description, and the operating software of the two processors can be transcutaneously changed, as described. Then the connection of the two modules provides essentially for data exchange for optimized binaural signal processing, for example, of the sensor signals.

Only one module contains the described digital signal processor. The module connection then provides, in addition to transmission of sensor data for binaural sound analysis and balancing, for transfer of the output signal to the contralateral transducer, wherein the latter module can house the electronic transducer driver. In this case, the operating software of the entire binaural system is filed in only one module, and the software also is changed transcutaneously only in this module from the outside via a telemetry unit which is present on only one side. In this case, the power supply of the entire binaural system can be housed in only one electronic module with power being supplied by wire or wirelessly to the contralateral module.

The described arrangements and measures are also useful in connection with hearing systems in which a plurality of electromechanical output transducers are provided for stimulation of fluid-filled inner ear spaces of a damaged inner ear, and in which the signal processing unit comprises driving signal processing electronics which electrically controls each of the transducers in a manner causing a traveling wave configuration to be formed on the basilar membrane of the damaged inner ear which approximates the manner of a traveling wave configuration of a healthy, undamaged inner ear as described in more detail in commonly owned co-pending U.S. patent application Ser. No. 09/833,704 which hereby is incorporated by reference, or in which the actoric stimulation arrangement comprises a dual intracochlear arrangement which includes in combination a stimulator arrangement having at least one stimulator element for an at least indirect mechanical stimulation of the inner ear and an electrically acting stimulation electrode arrangement having at least one cochlear implant electrode for electrical stimulation of the inner ear as described in more detail in commonly owned U.S. patent application Ser. No. 09/833,643 which hereby is incorporated by reference.

While various embodiments in accordance with the present invention have been shown and described, it is understood that the invention is not limited thereto. These embodiments may be changed, modified and further applied by those skilled in the art. Therefore, this invention is not limited to the details shown and described previously but also includes all such changes and modifications which are encompassed by the appended claims.

I claim:

1. An at least partially implantable system for rehabilitation of a hearing disorder comprising:

at least one acoustic sensor for picking up acoustic sensor signals and converting the acoustic sensor signals into corresponding electrical audio sensor signals, an electronic signal processing unit for audio signal processing and amplification of the electrical sensor signals, an electrical power supply unit which supplies individual components of the system with energy, at least one electromechanical output transducer which has an electrical input impedance and which, when implanted, is coupled via a coupling element to at least one of a middle ear and an inner ear for mechanical stimulation thereof, and means for objectively determining the quality of coupling between the at least one output transducer and at least one of the middle ear and the inner ear, said determining means comprising impedance measuring means for measuring the mechanical impedance of a biological load structure which, upon implantation of the output transducer, is coupled to the output transducer.

2. The system as claimed in claim 1, wherein the impedance measuring means comprises means for measuring the electrical input impedance of the electromechanical output transducer coupled to the biological load structure.

3. The system as claimed in claim 2, wherein the electromechanical output transducer is driven by a driver unit having an internal resistance, to which driver unit the output transducer is connected via a measuring resistance across which a measuring voltage proportional to a transducer current is dropped, an wherein a measuring amplifier is provided, which measuring amplifier has applied thereto as input signals said measuring voltage and a transducer terminal voltage.

4. The system as claimed in claim 3, comprising means for taking off the measuring voltage drop in a floating and high impedance manner.

5. The system as claimed in claim 3, wherein the measuring resistance is dimensioned such that the sum of the resistance value of the measuring resistance and of the absolute value of the complex electrical input impedance of the electromechanical output transducer coupled to the biological load structure is large with respect to the internal resistance of the driver unit.

6. The system as claimed in claim 3, comprising means for providing the quotient of the transducer terminal voltage and the transducer current.

7. The system as claimed in claim 1, wherein the impedance measuring means is designed for direct measurement of the mechanical impedance of the biological load structure coupled, upon implantation of the output transducer, to the electromechanical output transducer and is integrated into the output transducer at an actoric output side thereof.

8. The system as claimed in claim 7, wherein the impedance measuring means is designed for generating measuring signals which are at least approximately proportional as to absolute value and phase to one selected from the group consisting of forces acting on the biological load structure and the velocity of the coupling element.

9. The system as claimed in claim 8, comprising means for providing the quotient of the measuring signal corresponding to the force acting on the biological load structure and of the measuring signal corresponding to the velocity of the coupling element.

10. The system as claimed in claim 1, comprising means for measuring the mechanical impedance of the biological load structure coupled, upon implantation of the output transducer, to the electromechanical output transducer as a function of at least one selected from the group consisting of the frequency and the level of a stimulation signal delivered by the output transducer.

11. The system as claimed in claim 10, comprising means for detecting a spectral distribution of resonance frequencies in the course of the mechanical impedance measured as a function of the frequency of the stimulation signal.

12. The system as claimed in claim 11, comprising means for detecting a difference between values of the mechanical impedance occurring at the resonance frequencies.

13. The system as claimed in claim 1, comprising a software surface including a module for adapting the system to an individual hearing disorder, said module, when activated, initiating a measurement of the mechanical impedance of the biological load structure which, upon implantation of the output transducer, is coupled to the output transducer, and further comprising means for telemetric transmission of respective impedance measurement results to the software surface for further evaluation.

14. The system as claimed in claim 1, comprising means for automatically carrying out at predetermined time intervals a measurement of the mechanical impedance of the biological load structure which, upon implantation of the output transducer, is coupled to the output transducer, and further comprising means for storing respective impedance measurement results in an implanted storage at least until retrieval of said impedance measurement results from the outside.

15. The system as claimed in claim 1, comprising means for automatically carrying out, at the occurrence of a predetermined operational implant condition, a measurement of the mechanical impedance of the biological load structure which, upon implantation of the output transducer, is coupled to the output transducer, and further comprising means for storing respective impedance measurement results in an implanted storage at least until retrieval of said impedance measurement results from the outside.

16. The system as claimed in claim 1, wherein the impedance measuring means is designed for direct measurement of the mechanical impedance of the biological load structure coupled, upon implantation of the output transducer, via a coupling rod to the electromechanical output transducer, the impedance measuring means being inserted into the coupling rod.

17. The system as claimed in claim 1, wherein the electronic signal processing unit comprises a digital signal processor which provides for processing of signals of the impedance measuring means and for at least one function selected from the group consisting of processing electrical audio sensor signals or generating digital signals for tinnitus masking.

18. The system as claimed in claim 17, wherein a rewritable implantable storage arrangement is assigned to the signal processor for storage and retrieval of an operating program, and wherein at least parts of the operating program are adapted to be at least partially replaced by data transmitted from an external unit via a telemetry means.

19. The system of claim 18, further comprising a buffer storage arrangement in which data transmitted from the external unit via the telemetry means are buffered before being relayed to the signal processor.

20. The system of claim 19, further comprising a checking logic for checking data stored in the buffer storage arrangement before said data are relayed to the signal processor.

21. The system of claim 17, comprising a microprocessor module for control of the digital signal processor via a data bus.

22. The system of claim 21, wherein the checking logic and the buffer storage arrangement are implemented in the microprocessor module.

23. The system of claim 21, wherein at least one of a plurality of program parts are adapted to be transferred between an external source, the microprocessor module and the signal processor via the data bus and a telemetry means.

24. The system of claim 21, wherein an implantable storage arrangement for storage of an operating program for the microprocessor module is assigned to the microprocessor module, and at least one of a plurality of parts of the operating program for the microprocessor module is adapted to be replaced by data transferred from an external unit via a telemetry means.

25. The system of claim 17, comprising at least two storage areas for storage and retrieval of at least said operating program of the signal processor.

26. The system of claim 19, wherein the buffer storage arrangement comprises at least two storage areas for storage and retrieval of data transferred from the external unit via the telemetry means.

27. The system of claim 17, wherein a preprogrammed read-only memory area is assigned to the signal processor.

28. The system of claim 18, wherein the telemetry means is adapted for transmission of operating parameters between the implantable part of the system and the external unit.

29. The system of claim 1, wherein the electrical power supply unit comprises an implantable rechargeable energy storage element, and wherein the system is totally implantable except for a wireless, transcutaneous charging device which is provided for charging of the energy storage element.

30. The system of claim 29, comprising a wireless remote control for control of implant functions by the implant wearer.

31. The system of claim 1, wherein the system is partially implantable, wherein said at least one acoustic sensor, said electronic signal processing unit, said power supply unit and a modulator/transmitter unit are contained in an external module to be worn externally on the body of a user, and wherein the at least one electromechanical output transducer is an implantable passive unit which receives operating energy and control data for the transducer and the clutch via the modulator/transmitter unit in the external module.

* * * * *